US006439573B1

(12) United States Patent
Sklar

(10) Patent No.: US 6,439,573 B1
(45) Date of Patent: Aug. 27, 2002

(54) METHOD OF PLAYING A HI-LO CARD GAME HAVING EIGHTS AS TRUMP CARDS

(76) Inventor: William H. Sklar, 715 Leicester St., Henderson, NV (US) 89015

( * ) Notice: Subject to any disclaimer, the term of this patent is extended or adjusted under 35 U.S.C. 154(b) by 11 days.

(21) Appl. No.: 09/634,701

(22) Filed: Aug. 8, 2000

Related U.S. Application Data

(60) Provisional application No. 60/148,575, filed on Aug. 13, 1999.

(51) Int. Cl.[7] ..... A63F 1/00
(52) U.S. Cl. ..... 273/292; 273/309
(58) Field of Search ..... 273/292, 274, 273/309

(56) References Cited

U.S. PATENT DOCUMENTS 3,998,462 A * 12/1976 Goott
4,651,997 A 3/1987 Wood
4,921,249 A * 5/1990 Kropkowski et al.
5,692,755 A 12/1997 Gutierrez
5,697,614 A * 12/1997 Potter et al.
5,810,663 A 9/1998 Bochichio et al.
5,813,673 A * 9/1998 Richardson
6,102,403 A * 8/2000 Kaufman
6,179,293 B1 * 1/2001 Herman
6,227,969 B1 * 5/2001 Yoseloff

OTHER PUBLICATIONS

Over/Under 13TM Blackjak, Copyright 1988, Gaming Concepts, Inc.*

* cited by examiner

*Primary Examiner*—Paul T. Sewell
*Assistant Examiner*—Nini R. Legesse
(74) *Attorney, Agent, or Firm*—Jeffrey D. Moy; Harry M. Weiss; Weiss, Moy & Harris, P.C.

(57) ABSTRACT

A method for playing a casino card having playing cards ranked in a conventional manner wherein deuces, or two's, are the lowest ranked playing cards, aces are the highest ranked playing cards, and eights are trump is disclosed. The method comprises the steps of: providing a standard playing deck of 52 cards, adding at least one additional playing card having a value of eight to the deck, beginning a hand of play for a game, shuffling the deck, each player makes a prediction as to whether a dealt playing card n will be a HI or LO card, a dealer deals the card n, and if the card n is an eight of any suit, all the players lose the game and the game is finished.

16 Claims, 3 Drawing Sheets

METHOD OF PLAYING A HI-LO CARD GAME HAVING EIGHTS AS TRUMP CARDS

CLAIM OF PRIORITY

This patent application claims the benefit of U.S. Provisional Application No. 60/148,575 Filed Aug. 13$^{th}$, 1999 in the name of William H. Sklar entitled: Method Of Playing A Hi-Lo Card Game Having Eights As Trump Cards.

BACKGROUND OF THE INVENTION

1. Field of the Invention

This invention relates to card games, and more specifically, to a method of playing a HI-LO card game variant wherein cards whose rank is eight are trump.

2. Description of the Related Art

Card games have been in existence for well over one thousand years. Historical research indicates that cards were introduced into Italy and Spain around 1370, most likely from Egypt. Even earlier history reflects that on New Year's Eve, 969, the Emperor Mu-tsung is reported to have played "domino cards" with his wife. Following the introduction of cards into Italy and Spain, within a few years they had spread to many parts of Europe, although record of their introduction into England dates almost 90 years later.

The city of Florence passed a statute on gambling Mar. 23, 1376, regulating the playing of "A certain game called naibbe, which has recently been introduced into these parts." A German ordinance in Regensburg on Jul. 23, 1378 declared various games, including "spilen mit der quarten" punishable by fine if played for stakes higher than permitted. Thankfully, to the benefit of many people and organizations, card playing and gaming is today an accepted form of entertainment.

Towards the goal of providing entertainment the search is always in progress to invent new card games to provide new and exciting play to people who have become jaded towards current or old card games. Therefore, a need existed for a method of playing a new card game that would provide fresh entertainment to card players and gamblers. A further need existed for a method of playing a new card game using a traditional card deck such that teaching the new card game method to people unfamiliar with it will be facilitated.

SUMMARY OF THE INVENTION

It is an object of the present invention to provide a method of playing a new card game that provides the experience of fresh entertainment to card players and gamblers.

It is another object of the present invention to provide for a method of playing a new card game using a traditional card deck such that teaching the new card game method to people unfamiliar with it is facilitated.

The foregoing and other objects, features, and advantages of the invention will be apparent from the following, more particular, description of the preferred embodiment of the invention, as illustrated in the accompanying drawings.

BRIEF DESCRIPTION OF THE PREFERRED EMBODIMENTS

According to one aspect of the invention, a method for playing a casino card having playing cards ranked in a conventional manner wherein deuces, or two's , are the lowest ranked playing cards, aces are the highest ranked playing cards, and eights are trump is disclosed. The method comprises the steps of: providing a standard playing deck of 52 cards, adding at least one additional playing card having a value of eight to the deck, beginning a hand of play for a game, shuffling the deck, each player makes a prediction as to whether a dealt playing card n will be a HI or LO card, a dealer deals the card n, and if the card n is an eight of any suit, all the players lose the game and the game is finished.

According to another aspect of the invention, a method for playing a casino card having playing cards ranked in a conventional manner wherein deuces, or two's, are the lowest ranked playing cards, aces are the highest ranked playing cards, and eights are trump is disclosed. The method comprises the steps of: providing a standard playing deck of 52 cards, adding at least one additional playing card having a value of eight to the deck, beginning a hand of play for a game, shuffling the deck, each player makes a prediction as to whether a dealt playing card n will be a HI or LO card, a dealer deals the card n, if the card n is an eight of any suit, all the players lose the game and the game is finished, if the card n is higher in rank than an eight, all the players who bet LO, lose the hand, if the card n is lower in rank than an eight, all the player's who bet HI lose the hand.

DESCRIPTION OF THE PREFERRED EMBODIMENT

Figure 1:
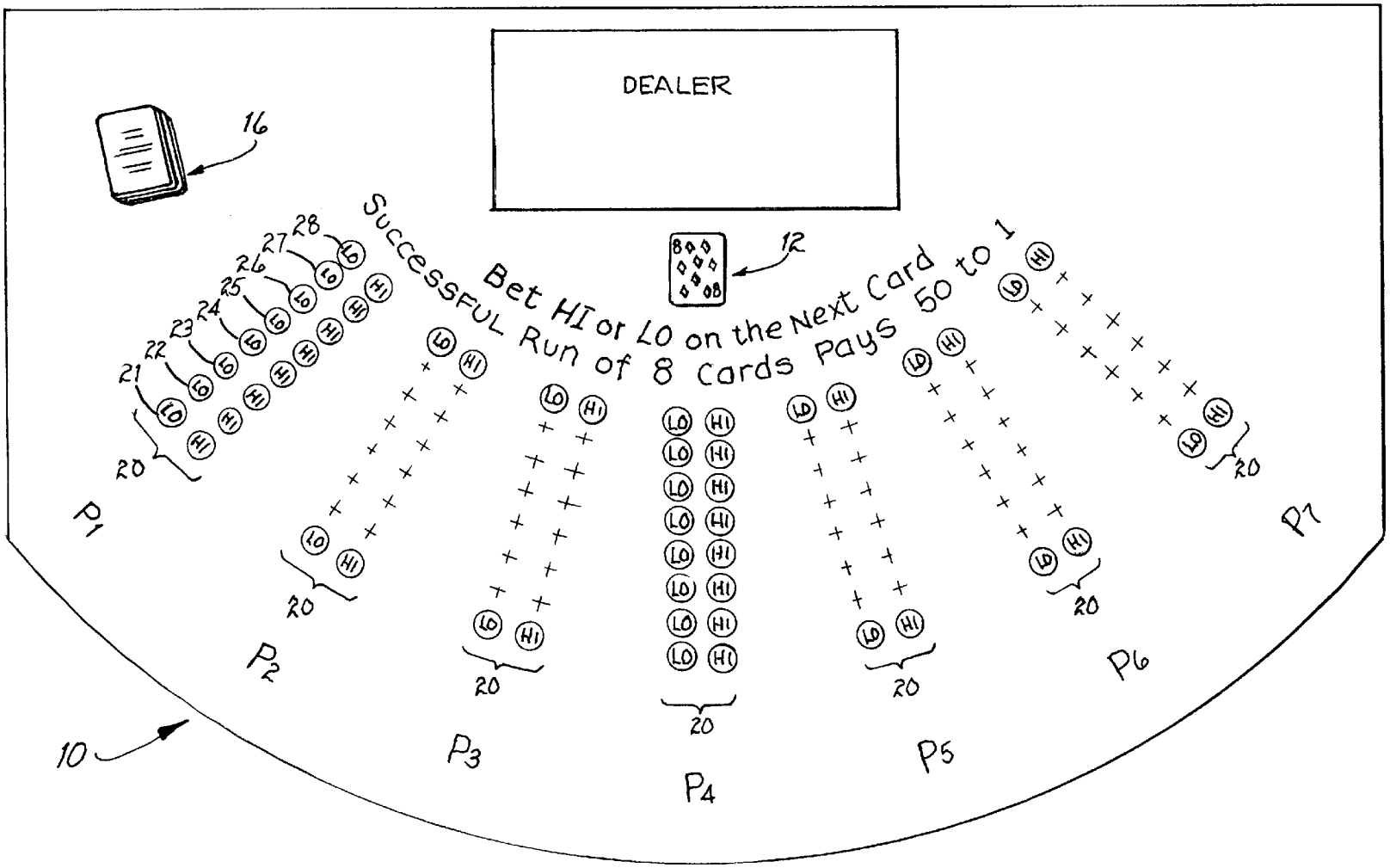
FIG. 1 is a diagram of the playing surface of the present invention.

Referring to FIG. 1, a diagram of the playing surface of the present invention, a method of playing a HI-LO card game variant ("the game" hereinafter) wherein cards whose rank is eight are trump, is shown (the "playing surface 10" hereinafter). The playing surface 10 has a dealt card indicia 12 permanently printed in front of the dealer's position DLR. The dealt card indicia 12 is an "eight" of any suit. All playing cards are dealt on top of the dealt card indicia 12 during the play of the game. The game is played utilizing a standard deck of 52 playing cards 16, to which is added one or more extra eights of any suit. Those well skilled in cards will recognize that as additional eights are added to the deck of playing cards, the betting odds will shift.

The basic object and setup for the game are as follows:

An object of the game is to predict whether the Nth+1 card dealt will be higher or lower than the Nth card that was dealt. Thus, in the play of the game, players do not compete against either the dealer or any other players, but against the fall of the next card. The playing cards are ranked in a conventional manner in that deuces, or two's , are the lowest ranked playing cards, and aces are the highest ranked playing cards. However, the game has as a feature, and as a variant from other HI-LO card games, that all eights, of any suit, are trump cards. An eight, or trump card, being dealt or showing up in play, ends the current game in the dealer's favor.

Figure 2:
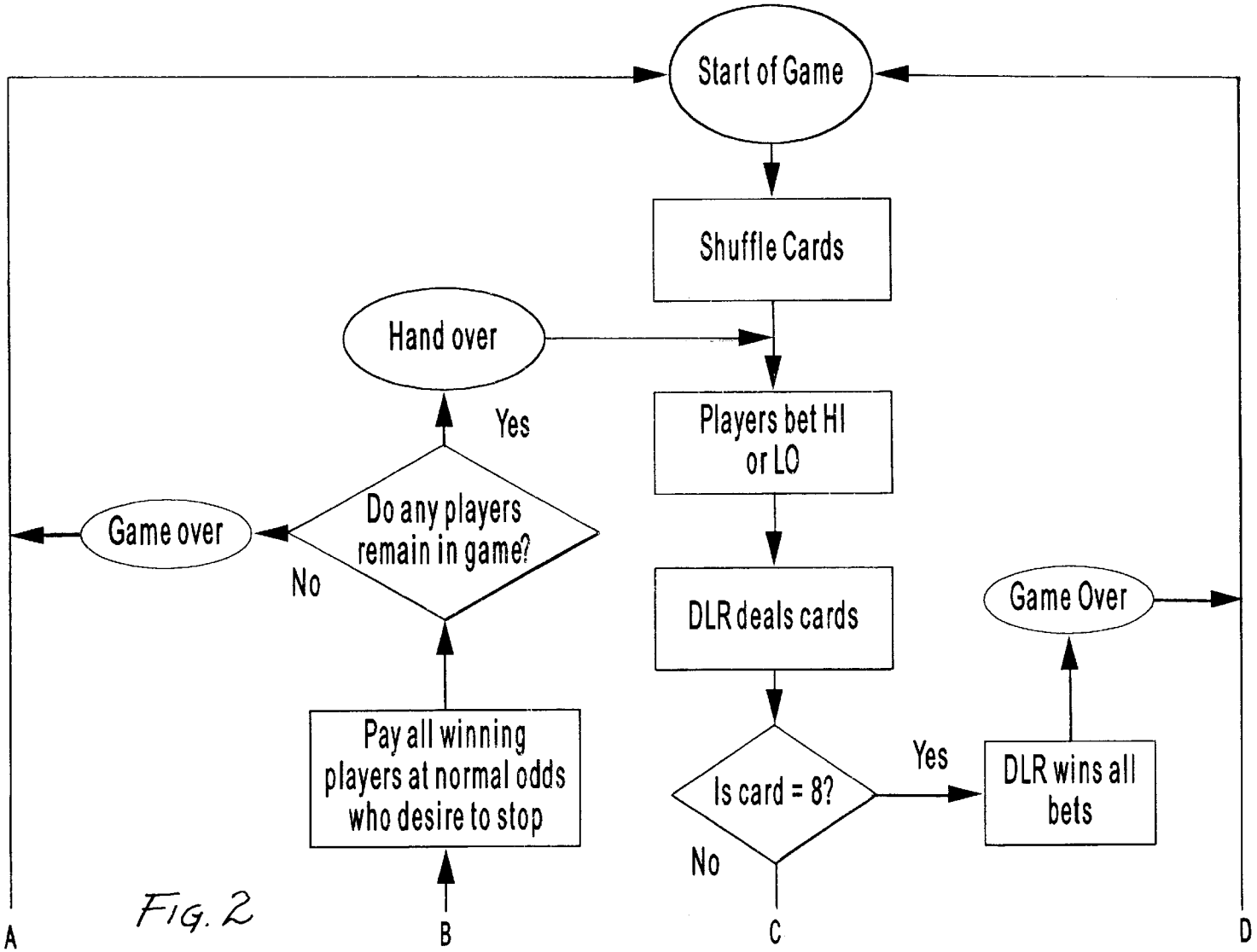
FIG. 2 is the first half of a flow chart of the order of play of the present invention.
Figure 3:
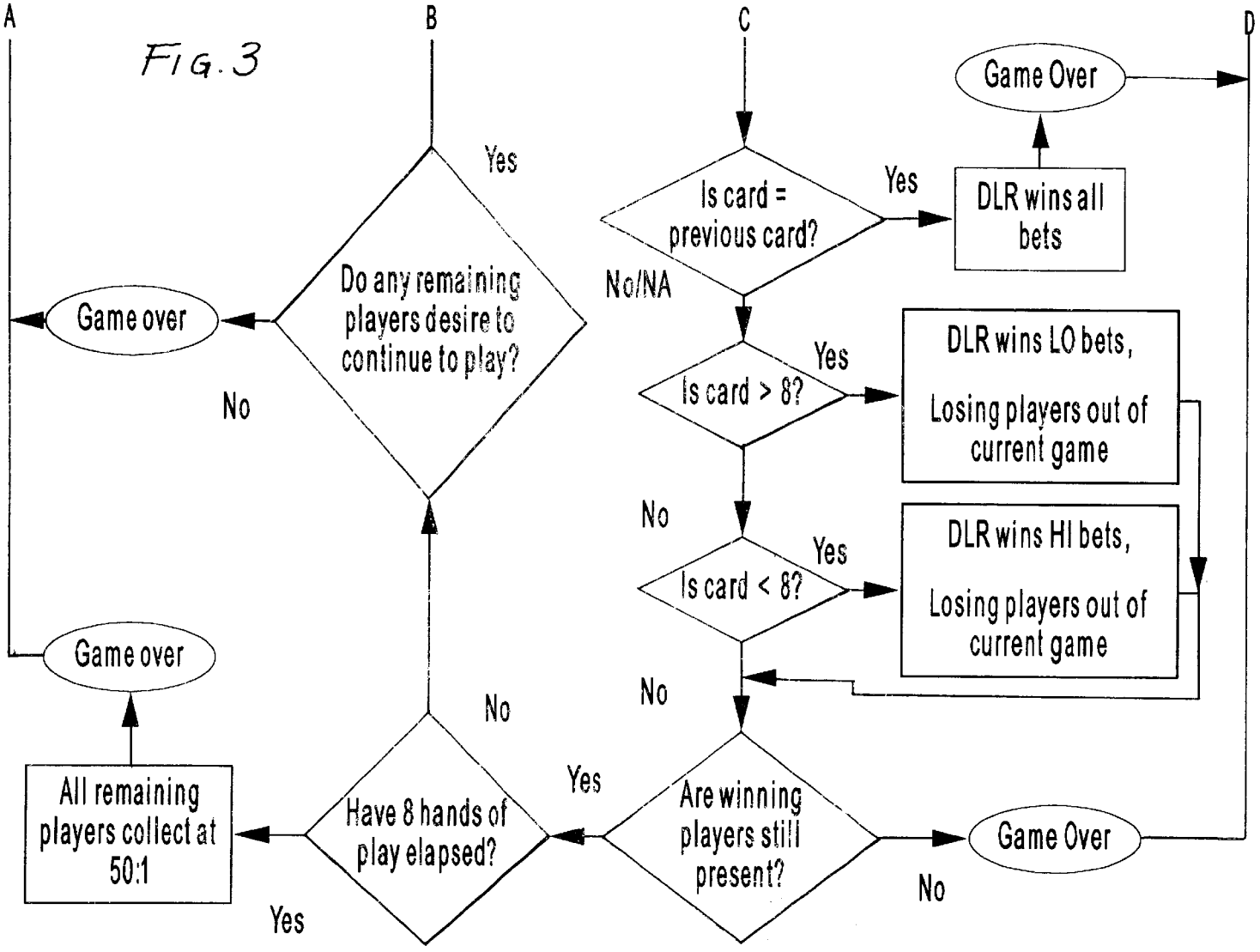
FIG. 3 is the second half of a flow chart of the order of play of the present invention.

The rules of play for the game are as follows:

With reference to FIGS. 1, 2 & 3, the deck of cards 16, including the desired number of additional eights is shuffled. The deck of cards is also shuffled at the beginning of each new game. A game lasts until all players have lost a hand, elected to discontinue playing, or stayed in the game play and won 8 continuous hands. The game begins with each player P1–7 making a prediction as to whether the next dealt playing card will be a HI or LO card. Each player P1–7 indicates their prediction by placing their wager upon appropriate LO/HI indicia 21. (Note that the LO/HI indicia 21–28 of the player's LO/HI indicia 20, are identical for all players positions P1–P7.) The dealer, standing at the DLR position, deals a card placing it upon the dealt card indicia 12. If the newly dealt card N is an eight of any suit, all players P1–7 lose. The dealer collects all wagers and the game is over. If the dealt card is higher in rank than an eight, all players P1–7 who bet low, indicated by their wager being placed on the "LO" indicia of the LO/HI indicia 21, lose. If the dealt card is lower in rank than an eight, all player's P1–7 who bet HI, indicated by their wager being placed on the "LO" indicia of the LO/HI indicia 21, lose. The losing player's wagers are removed from the playing surface 10 by the dealer and those players P1–7 can no longer wager until the next game begins. The players P1–7 who correctly predicted the relationship, LO or HI, have won this hand. They now have the option of either collecting their winnings or of playing the next hand by betting HI or LO and placing another wager of equal value to their original wager upon the next set of LO/HI indicia 22.

After all players P1–7 have made their decision or wager, the dealer will begin the next hand of play by turning over the next card N+1 and comparing this card to the previous card N. As before, if the new card N+1 is an eight, then the game is over and all players P1–7 still in the game lose all wagers on the table which are collected by the dealer. Additionally, for all dealt cards after the Nth card, N+1$^{st}$, N+2$^{nd}$, N+3$^{rd}$, etc. if the dealt card is equal in value to the previously dealt card of that particular hand, than all players P1–7 still in the game lose and the dealer collects all bets. If the dealt card N+1 is higher in rank than an eight, all players P1–7 who bet low, indicated by their wager being placed on the "LO" indicia of the LO/HI indicia 21, lose. If the dealt card N+1 is lower in rank than an eight, all players P1–7 who bet HI, indicated by their wager being placed on the "LO" indicia of the LO/HI indicia 22, lose. The losing player's wagers are removed from the playing surface 10 by the dealer and those players P1–7 can no longer wager until the next game begins. The players P1–7 who correctly predicted the relationship, LO or HI, now have the option of either collecting their winnings or betting HI or LO again by putting up another wager of equal value to their original wager upon the next set of LO/HI indicia 23.

The play of the game continues in this fashion as shown by the flowchart on FIGS. 2 and 3 until one of the following conditions occurs:

1) All players P1–7 have made a wrong wager and are out of the current game.
2) All players P1–7 elect to collect their winnings and no longer participate in that game.
3) The game has run for eight hands of play and at least one player P1–7 has successfully predicted the next cards relative rank for each of the eight hands. For those players so skilled, the game is over, but they have won and will collect at the rate of 50:1 for their wagers.

Variations for the play of the game include:

1) Betting on whether the next card N+1 ties the current card N in rank. Noting of course that this is analogous to an insurance wager in that if the card N+1 ties the current card N, the dealer wins and the game is over.
2) Placing a side bet as to whether a fellow player successfully predicts all eight cards in a row.
3) Allowing a player to vary their bets as the game progresses.
4) Betting that a specific card will appear before the game ends Again, reference to the flow chart of FIGS. 2 and 3 show the order of play for a game.

While the invention has been particularly shown and described with reference to the preferred embodiments thereof, it will be understood by those skilled in the art that the foregoing and other changes in form, and details may be made therein without departing from the spirit and scope of the invention. It should also be noted that, as is the case with many card games, this game is easily adapted to be embodied within and played upon a video or computer gaming machine.

I claim:

1. In a method for playing a casino card having playing cards ranked in a conventional manner wherein deuces, or two's, are the lowest ranked playing cards, aces are the highest ranked playing cards, and eights are trump, the steps comprised of:

providing a standard playing deck of 52 cards;

adding at least one additional playing card having a value of eight to said deck;

beginning a hand of play for a game;

shuffling said deck;

each player makes a prediction as to whether a dealt playing card n will be a HI or LO card;

a dealer deals said card n;

if said card n is an eight of any suit, all said players lose said game and said game is finished;

if said card n is higher in rank than an eight, all said players who bet LO, lose said hand;

if said card n is lower in rank than an eight, all said players who bet HI, lose said hand;

wherein all said players who lost said hand no longer participate until a next game n+1 begins;

wherein all said players who correctly predicted the relationship between said card n and their respective said prediction win said hand and are winning players for said hand;

wherein said winning players may either collect their winning or may become players of a hand n+1;

wherein each of said players of said hand n+1 makes a prediction as to whether the next dealt playing card n+1 will be a HI or LO card;

each of said players of said hand n+l places a wager of equal value to their original wager made in hand n;

said dealer deals said card n+1; and if said card n+1 is an eight of any suit, all said players of said hand n+1 lose said game and said game is finished.

2. The method of claim 1 further comprising the step wherein if said card n+1 is equal in value to the previously dealt card n of said hand n, than all of said players of said hand n+1 lose said game and said game is finished.

3. The method of claim 2 further comprising the step wherein if said card n+1 is higher in rank than an eight, all said players of said hand n+1 who bet LO, lose said hand n+1.

4. The method of claim 3 further comprising the step wherein if said card n+1 is lower in rank than an eight, all said players of said hand n+1 who bet high, lose said hand n+1.

5. The method of claim 4 further comprising the step wherein all said players of said hand n+1 who lost no longer participate in playing until said next game n+1 begins.

6. The method of claim 5 further comprising the step wherein the playing of said game continues through successive hands n+1 until one of the following occurs:

all players of said hand n+1 have made a wrong prediction and are out of said game or said game n+1;

all players of said hand n+1 elect to collect their winnings and no longer participate in said game or said game n+1; and said game or said game n+1 has run for eight hands of play and at least one player has successfully predicted the next card n or n+1 relative rank for each of said eight hands, wherein said at least one player who successfully predicted the next card n or n+1 relative rank are winners.

7. In a method for playing a casino card having playing cards ranked in a conventional manner wherein deuces, or two's , are the lowest ranked playing cards, and aces are the highest ranked playing cards, the steps comprised of:

providing a standard playing deck of 52 cards;

adding at least one additional playing card having a value of eight to said deck;

beginning a hand of play for a game;

shuffling said deck;

each player makes a prediction as to whether a dealt playing card n will be a HI or LO card;

a dealer deals said card n;

if said card n is an eight of any suit, all said players lose said game and said game is finished;

if said card n is higher in rank than an eight, all said players who bet LO, lose said hand;

if said card n is lower in rank than an eight, all said player's who bet HI lose said hand.

8. The method of claim 7 further comprising the step wherein all said players who lost said hand no longer participate until a next game n+1 begins.

9. The method of claim 8 further comprising the step wherein all said players who correctly predicted the relationship between said card n and their respective said prediction win said hand and are winning players for said hand.

10. The method of claim 9 further comprising the step wherein said winning players may either collect their winnings or may instead become players of a hand n+1.

11. The method of claim 10 further comprising the steps:

wherein each of said players of said hand n+1 makes a prediction as to whether the next dealt playing card n+1 will be a HI or LO card;

each of said players of said hand n+1 a wager of equal value to their original wager made in hand n;

said dealer deals said card n+1; and if said card n+1 is an eight of any suit, all said players of said hand n+1 lose said game and said game is finished.

12. The method of claim 11 further comprising the step wherein if said card n+1 is equal in value to the previously dealt card n of said hand n, than all said players of said hand n+1 lose said game and said game is finished.

13. The method of claim 12 further comprising the step wherein if said card n+1 is higher in rank than an eight, all said players of said hand n+1 who bet LO, lose said hand n+1.

14. The method of claim 13 further comprising the step wherein if said card n+1 is lower in rank than an eight, all said players of said hand n+1 who bet high, lose said hand n+1.

15. The method of claim 14 further comprising the step wherein all said players of said hand n+1 who lost no longer participate in playing until said next game n+1 begins.

16. The method of claim 15 further comprising the step wherein the playing of said game continues through successive hands n+1 until one of the following occurs:

all players of said hand n+1 have made a wrong prediction and are out of said game or said game n+1;

all players of said hand n+1 elect to collect their winnings and no longer participate in said game or said game n+1; and said game or said game n+1 has run for eight hands of play and at least one player has successfully predicted the next card n or n+1 relative rank for each of said eight hands, wherein said at least one player(s) who successfully predicted the next card n or n+1 relative rank are winners.

* * * * *